US008080169B2

(12) United States Patent
Kariya

(10) Patent No.: US 8,080,169 B2
(45) Date of Patent: Dec. 20, 2011

(54) PROCESS FOR PRODUCING EXTINGUISHING AGENT AND THROW-TYPE FIRE EXTINGUISHER

(75) Inventor: Koushi Kariya, Tokyo (JP)

(73) Assignee: Bonex, Inc., Tokyo (JP)

( * ) Notice: Subject to any disclaimer, the term of this patent is extended or adjusted under 35 U.S.C. 154(b) by 119 days.

(21) Appl. No.: 12/561,629

(22) Filed: Sep. 17, 2009

(65) Prior Publication Data

US 2010/0000746 A1 Jan. 7, 2010

Related U.S. Application Data

(63) Continuation-in-part of application No. 11/198,321, filed on Aug. 8, 2005, now abandoned.

(51) Int. Cl.
*A62D 1/00* (2006.01)
*A62D 1/06* (2006.01)
*A62C 13/00* (2006.01)

(52) U.S. Cl. ..... 252/7; 252/2; 169/30; 169/44

(58) Field of Classification Search ..... 252/2, 7
See application file for complete search history.

(56) References Cited

U.S. PATENT DOCUMENTS

| | | | |
|---|---|---|---|
| 3,196,108 | A | 7/1965 | Nelson |
| 3,334,045 | A | 8/1967 | Nelson |
| 3,843,525 | A | 10/1974 | Hattori et al. |
| 4,107,053 | A | 8/1978 | Kennington et al. |
| 4,346,012 | A | 8/1982 | Umaba et al. |
| 4,420,434 | A | 12/1983 | Falk |
| 4,961,865 | A | 10/1990 | Pennartz |
| 5,778,984 | A | 7/1998 | Suwa |
| 2003/0218148 | A1 | 11/2003 | Stewart et al. |
| 2007/0029518 | A1 | 2/2007 | Hatakeyama |

FOREIGN PATENT DOCUMENTS

| | | | |
|---|---|---|---|
| CN | 1188678 | A | 7/1998 |
| CN | 2005-10013130 | | 7/2005 |
| GB | 1601016 | | 10/1981 |
| GB | 2257042 | | 1/1993 |
| JP | 2001-37901 | A | 2/2001 |
| WO | WO 99/26698 | | 3/1999 |

*Primary Examiner* — Peter F Godenschwager
(74) *Attorney, Agent, or Firm* — Berenato & White, LLC

(57) ABSTRACT

A process is provided for producing an extinguishing agent. Sodium chloride and ammonium dihydrogenphosphate are dissolved in hot water at a temperature of 30 to 40° C. to form a solution. Ammonium hydrogen carbonate is dissolved into the solution, and allowed to undergo a reaction with the ammonium dihydrogenphosphate, as dissolved. The sodium chloride is present in the extinguishing agent in a ratio of 5 to 15 g per 500 ml of water, the ammonium dihydrogenphosphate is present in the extinguishing agent in a ratio of 50 to 70 g per 500 ml of water, and ammonium hydrogen carbonate is present in the extinguishing agent in a ratio of 50 to 70 g per 500 ml of water. Also provided is a process of producing a throw-type fire extinguisher.

4 Claims, No Drawings

PROCESS FOR PRODUCING EXTINGUISHING AGENT AND THROW-TYPE FIRE EXTINGUISHER

CROSS-REFERENCE TO RELATED APPLICATION(S)

This application is a continuation-in-part of U.S. Ser. No. 11/198,321 filed Aug. 8, 2005 now abandoned, the complete disclosure of which is incorporated herein by reference.

BACKGROUND OF THE INVENTION

1. Field of the Invention

The present invention relates to a process for producing an extinguishing agent for fire.

2. Description of Related Arts

Extinguishing agents have been made up of various compositions. For example, Japanese patent Laid-Open Publication No. 2001-37901 discloses an extinguishing agent containing urea, sodium chloride, sodium carbonic anhydride, ammonium sulfate and the like.

However, amongst processes for producing an extinguishing agent, many of them do not disclose the detail of production as know-how of venders. A process for producing an extinguishing agent will be disclosed herein.

In recent years, in addition to a floor-type fire extinguisher, a throwing-type fire extinguisher has been commercialized. A throwing-type fire extinguisher is typically thrown to the origin of a fire after it has started. Because it is sometimes difficult to use the floor-type fire extinguisher in the course of extinguishing a fire, a throwing-type fire extinguisher, which can extinguish a fire by throwing it from a distance into the fire, such as at the origin of a fire, may be preferred due to its easiness and convenience of application.

However, not all of the constituents of conventional fire extinguishing agents are necessarily safe. There is a possibility that problems may arise when a child or an aged person drinks or otherwise consumes the agent by mistake.

Accordingly, there is a need for a process for producing a safe extinguishing agent, which has no or little harmful influence on the human body.

Furthermore, there is a need for providing a process for producing a safe extinguishing agent, which effectively conducts a treatment so that components incorporated therein may exhibit their action, to thereby produce an extinguishing agent having a high fire-extinguishing performance.

SUMMARY OF THE INVENTION

Accordingly to a first aspect of the present invention, there is provided a process for producing an extinguishing agent. Sodium chloride, ammonium dihydrogenphosphate and ammonium hydrogen carbonate are dissolved in hot water at a temperature of 30 to 40° C. to form a solution. The ammonium dihydrogenphosphate and the ammonium hydrogen carbonate as dissolved, are allowed to undergo a reaction. The sodium chloride is present in the extinguishing agent in a ratio of 5 to 15 g per 500 ml of water, the ammonium dihydrogenphosphate is present in the extinguishing agent in a ratio of 50 to 70 g per 500 ml of water, and the ammonium hydrogen carbonate is present in the extinguishing agent in a ratio of 50 to 70 g per 500 ml of water.

The process of the above first aspect of the invention may further comprise a step of incorporating a surfactant in the extinguishing agent.

According to a second aspect of the present invention, there is provided a process for producing an extinguishing agent. Sodium chloride, ammonium dihydrogenphosphate, ammonium hydrogen carbonate, urea and ammonium sulfate are dissolved in hot water at a temperature of 30 to 40° C. to form a solution. The ammonium dihydrogenphosphate and the ammonium hydrogen carbonate, as dissolved, are allowed to undergo a reaction. The sodium chloride is present in the extinguishing agent in a ratio of 5 to 15 g per 500 ml of water, the ammonium dihydrogenphosphate is present in the extinguishing agent in a ratio of 50 to 70 g per 500 ml of water, the ammonium hydrogen carbonate is present in the extinguishing agent in a ratio of 50 to 70 g per 500 ml of water, the urea is present in the extinguishing agent in a ratio of 20 to 40 g per 500 ml of water, and the ammonium sulfate is present in the extinguishing agent in a ratio of 35 to 55 g per 500 ml of water.

The process according to the second aspect of the invention may further comprise a step on incorporating a surfactant in the extinguishing agent.

Additional aspects of the invention involve processes of producing a throw-type fire extinguisher, and processes of extinguishing a fire with a throw-type fire extinguisher.

Still additional aspects of the invention involve processes of producing a throw-type fire extinguisher containing extinguishing agents such as those described herein.

DESCRIPTION OF THE EXEMPLARY EMBODIMENTS

First Embodiment

A first embodiment of the present invention will now be described.

First, 5 to 15 g, e.g., 10 g of sodium chloride is incorporated in 300 ml of water at a temperature ranging from 30 to 40° C., for example, approximately, 40° C., and then the mixture is stirred to dissolve sodium chloride into water. Sodium chloride is utilized as a catalyst.

Subsequently, 50 to 70 g, for example, 60 g of ammonium dihydrogenphosphate is incorporated and dissolved therein, and 50 to 70 g, for example, 60 g of ammonium hydrogen carbonate is incorporated to cause a reaction to be dissolved.

Ammonium dihydrogenphosphate and ammonium hydrogen carbonate are thermally decomposed into carbon dioxide gas ($CO_2$) and ammonia gas ($NH_3$) during the course of fire extinguishing through combustion. Carbon dioxide gas has a function of preventing the supply of oxygen to burning products and a function of neutralizing and suppressing oxidation of burning products. Ammonia gas, which possesses a neutralization function and a cooling function, prevents re-ignition of burning products to prevent fire from spreading to surroundings.

Subsequently, 200 ml of boiling water is added to the solution to bring the total amount of extinguishing agent to 500 ml, and the temperature to about 60 to about 70° C. The agent is allowed to cool at room temperature.

Finally, as occasion may demand, effective amount, e.g., a surfactant (e.g., alpha foam: surfactant for forming aqueous membrane foam, available from Yamato Protec K. K.) in a ratio of approximately 20 ml to 500 ml of the extinguishing agent is added.

Reactions brought about by combustion in the course of extinguishing fire are as follows:

$$(NH_4)_2HPO_3+NH_4HCO_3 \rightarrow PO_4+H_2O+4NH_3+CO_2$$

$$PO_4+H_2O+4NH_3+CO_2+CO(NH_2)_2 \rightarrow (2NH_3)_3PO_4+2CO_2+H_2$$

The extinguishing agent thus produced is incorporated into a container to be ready for use. The container in which the extinguishing agent of the present invention is incorporated may be various kinds of containers which can store the extinguishing agent of the present invention. Preferably, the container does not deteriorate the quality of the extinguishing agent of the present invention to maintain the agent in a stable manner, and does not react with the extinguishing agent of the present invention.

An example of a container which can be used is a polyvinylchloride (PVC) container. The container, particularly PVC containers, may have a minimum wall thickness of about 0.3 mm to about 0.7 mm (e.g., 0.5 mm) and is resistant to cracking at internal pressures up to at least 0.06 MPa. The internal pressure capacity of a container may be measured by inserting a pipe to the container, and gradually increasing pressure in the container until a fail point at which the container cracks. The container preferably is capable of sustaining an internal pressure of 0.6 MPa or greater before cracking, meaning the container does not crack at 0 to 0.6 MPa, and possibly higher.

Second Embodiment

Next, a second embodiment of the present invention will be described.

First, 5 to 15 g, for example, 10 g of sodium chloride is incorporated in 300 ml of water at 30° C., and then the mixture is stirred to dissolve the sodium chloride into the water. The sodium chloride is utilized as a catalyst.

Subsequently, 50 to 70 g, for example, 50 g of ammonium dihydrogenphosphate is incorporated and dissolved therein, and 50 to 70 g, for example, 50 g of ammonium hydrogen carbonate is incorporated to cause a reaction to be dissolved.

Subsequently, 20 to 40 g, for example, 20 g of urea is incorporated and dissolved in the solution. Thereafter, 35 to 55 g, for example, 45 g of ammonium sulfate is incorporated and dissolved in the solution.

Ammonium dihydrogenphosphate, ammonium hydrogen carbonate, urea and ammonium sulfate are thermally decomposed into carbon dioxide gas and ammonia gas during the course of fire extinguishing through combustion. Carbon dioxide gas has a function of preventing the supply of oxygen to burning products and a function of neutralizing and suppressing oxidation of burning products. Ammonia gas, which possesses a neutralization function and a cooling function, prevents re-ignition of burning products to prevent fire from spreading to the surroundings.

Subsequently, 200 ml of boiling water is added to the solution to bring the total amount of extinguishing agent to 500 ml, and to bring the temperature to about 60 to about 70° C. The solution is allowed to cool at room temperature.

Finally, as occasion may demand, 20 ml of surfactant (e.g., alpha foam) is added to 500 ml of the extinguishing agent.

The addition of boiling water after the ammonium dihydrogenphosphate, ammonium hydrogen carbonate, urea, and ammonium sulfate have been added container raises the temperature of the solution, generating relatively large amounts of ammonia and carbon dioxide before the container is even shut. The loss and resulting shortage of ammonium dihydrogenphosphate, ammonium hydrogen carbonate, and ammonium sulfate can adversely affect the fire extinguishing properties of the agent. On the other hand, the addition of lukewarm or hot water (instead of boiling) causes relatively small amounts of ammonia and carbon dioxide to be produced before the container is sealed. While the agent possesses excellent fire extinguishing properties, the container is more susceptible to cracking at high temperatures, such as may be experienced during summertime, e.g., about 40° C.

The extinguishing agent thus produced is loaded in a container to be ready for use. Alternatively, loading may involve forming the extinguishing agent in situ in the container. The container in which the extinguishing agent of this and other embodiments of the invention is loaded may be one of various kinds of containers which can store the extinguishing agent of the present invention without deteriorating the quality of the extinguishing agent of the present invention to keep the agent in a stable manner. The container also preferably does not react with the extinguishing agent of the present invention.

An example of a container which can be used is a polyvinylchloride (PVC) container. The container, particularly PVC containers, may have a minimum wall thickness of about 0.3 mm to about 0.7 mm (e.g., 0.5 mm) and is resistant to cracking at internal pressures up to at least 0.06 MPa. The internal pressure capacity of a container may be measured by inserting a pipe to the container, and gradually increasing pressure in the container until a fail point at which the container cracks. The container preferably is capable of sustaining an internal pressure of 0.6 MPa or greater before cracking, meaning the container does not crack at 0 to 0.6 MPa, and possibly higher.

In the practice of embodiments of the present invention, when fire occurs, a person throws the container at the fire. When the container hits a burning object, the container preferably breaks easily and the solution (the extinguishing agent) is expelled. Ammonium dihydrogenphosphate, ammonium hydrogen carbonate, urea, and ammonium sulfate generate ammonia and carbon dioxide due to the heat of fire. Ammonia and carbon dioxide cause the fire to be extinguished.

According to the first and second embodiments of the process for producing an extinguishing agent of the present invention, a safety extinguishing agent having no or little harmful effects upon human body can be provided. The use of ammonium hydrogen sulfate increases extinguishing rate.

The extinguishing rate when a conventional ammonium carbonate is used and when ammonium hydrogen carbonate is used are shown below.

TABLE 1

| | Rate |
|---|---|
| Ammonium carbonate | 45 seconds |
| Ammonium hydrogen carbonate | 25 seconds |

When being incorporated into an appropriate container, the extinguishing agent produced according to the present invention can be used for a fire extinguisher which is thrown at the origin of a fire when fire occurs. A safety extinguishing agent having no or little influence upon human body can be provided. The use of ammonium hydrogen sulfate increases extinguishing rate.

EXPERIMENTAL EXAMPLES

In order to determine an appropriate temperature of the solution to be generated by adding the boiling/hot/lukewarm water to the container containing the ammonium dihydrogenphosphate, ammonium hydrogen carbonate, urea, and ammonium sulfate, the following experiments were conducted.

Experiment 1

1. Prepare containers made of thin polyvinylchloride (PVC) plastic (530 ml, 0.5 mm thick).

2. Add 300 ml of 30° C. water and 10 g of sodium chloride into each container.

3. Add 60 g of ammonium dihydrogenphosphate into each container.

4. Add 60 g of ammonium hydrogen carbonate into each container.

5. Add boiling water, hot water, or lukewarm water to bring the temperature of the solution to 30° C. (four containers), 40° C. (four containers), 50° C. (four containers), 60° C. (four containers), and 70° C. (four containers). Total amount of the solution in each container is 510 ml.

6. Leave the containers to sit in an open state and allow ammonia and carbon dioxide to be generated.

7. Close the containers.

8. Allow the solution in the containers to reach room temperature.

9. To test the stability of the different agents, two samples of each container (prepared at 30, 40, 50, 60, and 70° C., respectively) were maintained at 40° C. in a water tank. Observations as to whether the containers crack or not were recorded.

Experiment 2

1. Prepare containers made of thin polyvinylchloride (PVC) plastic (530 ml, 0.5 mm thick).

2. Add 300 ml of 30° C. water and 10 g of sodium chloride to each container.

3. Add 60 g of ammonium dihydrogenphosphate into each container.

4. Add 60 g of ammonium hydrogen carbonate into each container.

5. Add 30 g of urea into each container.

6. Add 45 g of ammonium sulfate into each container.

7. Add boiling water, hot water, or lukewarm water to bring the temperature of the solution to 30° C. (four containers), 40° C. (four containers), 50° C. (four containers), 60° (four containers), and 70° C. (four containers). Total amount of the solution in each container is 510 ml.

8. Leave the containers to sit in an open state and allow ammonia and carbon dioxide to be generated.

9. Close the containers.

10. Allow the solution in the containers to reach room temperature.

11. To test the stability of the different agents, two samples of each container (prepared at 30, 40, 50, 60, and 70° C., respectively) were maintained at 40° C. in a water tank. Observations as to whether the containers crack or not were recorded.

12. To test the extinguishing capability of each container, a pan (length 73 cm) was set directly below a crib (height 1 meter; width 73 cm; depth 73 cm). 1.5 liters of heptane were placed in the pan and a fire was generated. The height of pillar of fire was about five meters.

13. Throw five containers of each container at the fire, one by one. Confirm whether the extinguishing agent can extinguish fire or not.

Experiment 1 Results

| | Lapse time | Result |
|---|---|---|
| Container (30° C.) | 5 minute 16 second | Crack, leak of the extinguishing agent |

-continued

| | Lapse time | Result |
|---|---|---|
| | 5 minute 26 second | Crack, leak of the extinguishing agent |
| Container (40° C.) | 32 minute 02 second | Crack, leak of the extinguishing agent |
| | 32 minute 44 second | Crack, leak of the extinguishing agent |
| Container (50° C.) | 1 hour 13 minute 27 second | Crack, leak of the extinguishing agent |
| | 1 hour 15 minute 54 second | Crack, leak of the extinguishing agent |
| Container (60° C.) | 2 hour | No cracks. |
| | 2 hour | No cracks. |
| Container (70° C.) | 2 hour | No cracks. |
| | 2 hour | No cracks. |

Experiment 2 Results

| | Lapse time | Result |
|---|---|---|
| Container (30° C.) | 4 minute 56 second | Crack, leak of the extinguishing agent |
| | 5 minute 27 second | Crack, leak of the extinguishing agent |
| Container (40° C.) | 28 minute 12 second | Crack, leak of the extinguishing agent |
| | 29 minute 36 second | Crack, leak of the extinguishing agent |
| Container (50° C.) | 1 hour 12 minute 38 second | Crack, leak of the extinguishing agent |
| | 1 hour 16 minute 14 second | Crack, leak of the extinguishing agent |
| Container (60° C.) | 2 hour | No cracks. |
| | 2 hour | No cracks. |
| Container (70° C.) | 2 hour | No cracks. |
| | 2 hour | No cracks. |

Both in the experiment 1 and in the experiment 2, all of the containers including solutions made at 30° C., 40° C. and 50° C. by adding hot water or lukewarm water cracked. On the other hand, in the experiment 1 and in the experiment 2, all of the containers including solutions made at 60° and 70° C. by adding boiling water did not crack.

From these experiments, it is revealed that the temperature of the solution is preferably raised to approximately 60° C. to approximately 70° C. by adding boiling water into the containers after the ingredients have been added into the containers. Before closing the containers, a relatively large amount of ammonia and carbon dioxide were generated. As a result, after closing the containers, the containers did not crack, even when subject to temperatures (e.g., 40° C.) comparable to those of a hot summer day.

Samples of each of the five containers including solutions made at 30-70° C. were found to extinguish fire. Because the solution/agent made at 70° C. were expected to contain relatively smaller amounts of ammonium dihydrogenphosphate, ammonium hydrogen carbonate, and ammonium sulfate than the other containers having agents prepared at lower temperatures, it was predicted that the 70° C.-prepared agent would have little or no fire extinguishing capabilities. However, it was surprisingly found that the agent was able to extinguish fires.

What is claimed is:

1. A process for producing an extinguishing agent, comprising:

dissolving sodium chloride, ammonium dihydrogenphosphate and ammonium hydrogen carbonate in hot water at a temperature of 30 to 40° C. to form a solution;

allowing the ammonium dihydrogenphosphate and the ammonium hydrogen carbonate, as dissolved, to undergo a reaction; and adding water to raise the temperature of the solution to about 60° C. to about 70° C., wherein the sodium chloride is present in the extinguishing agent in a ratio of 5 to 15 g per 500 ml of water, the ammonium dihydrogenphosphate is present in the extinguishing agent in a ratio of 50 to 70 g per 500 ml of water, and the ammonium hydrogen carbonate is present in the extinguishing agent in a ratio of 50 to 70 g per 500 ml of water.

2. A process for producing an extinguishing agent comprising:

dissolving sodium chloride, ammonium dihydrogenphosphate, ammonium hydrogen carbonate, urea and ammonium sulfate in hot water at a temperature of 30 to 40° C. to form a solution;

allowing the ammonium dihydrogenphosphate and the ammonium hydrogen carbonate as dissolved, to undergo a reaction; and adding water to raise the temperature of the solution to about 60° C. to about 70° C., wherein the sodium chloride is present in the extinguishing agent in a ratio of 5 to 15 g per 500 ml of water, the ammonium dihydrogenphosphate is present in the extinguishing agent in a ratio of 50 to 70 g per 500 ml of water, the ammonium hydrogen carbonate is present in the extinguishing agent in a ratio of 50 to 70 g per 500 ml of water, the urea is present in the extinguishing agent in a ratio of 20 to 40 g per 500 ml of water, and the ammonium sulfate is present in the extinguishing agent in a ratio of 35 to 55 g per 500 ml of water.

3. A process of producing a throw-type fire extinguisher containing an extinguishing agent, comprising:

dissolving sodium chloride, ammonium dihydrogenphosphate and ammonium hydrogen carbonate in hot water at a temperature of 30 to 40° C. to form a solution;

allowing the ammonium dihydrogenphosphate and the ammonium hydrogen carbonate, as dissolved, to undergo a reaction;

loading the solution in a container;

adding water to the container to raise the temperature of the solution to about 60° C. to about 70° C.; and closing the container, wherein the sodium chloride is present in the extinguishing agent in a ratio of 5 to 15 g per 500 ml of water, the ammonium dihydrogenphosphate is present in the extinguishing agent in a ratio of 50 to 70 g per 500 ml of water, and the ammonium hydrogen carbonate is present in the extinguishing agent in a ratio of 50 to 70 g per 500 ml of water.

4. A process of producing a throw-type fire extinguisher containing an extinguishing agent, comprising:

dissolving sodium chloride, ammonium dihydrogenphosphate, ammonium hydrogen carbonate, urea and ammonium sulfate in hot water at a temperature of 30 to 40° C. to form a solution;

allowing the ammonium dihydrogenphosphate and the ammonium hydrogen carbonate as dissolved, to undergo a reaction;

loading the solution in a container;

adding water to the container to raise the temperature of the solution to about 60° C. to about 70° C.; and closing the container, wherein the sodium chloride is present in the extinguishing agent in a ratio of 5 to 15 g per 500 ml of water, the ammonium dihydrogenphosphate is present in the extinguishing agent in a ratio of 50 to 70 g per 500 ml of water, the ammonium hydrogen carbonate is present in the extinguishing agent in a ratio of 50 to 70 g per 500 ml of water, the urea is present in the extinguishing agent in a ratio of 20 to 40 g per 500 ml of water, and the ammonium sulfate is present in the extinguishing agent in a ratio of 35 to 55 g per 500 ml of water.

* * * * *